US005662063A

United States Patent [19]

Seijas

[11] Patent Number: 5,662,063

[45] Date of Patent: Sep. 2, 1997

[54] FLOTATION SAFETY DEVICE

[76] Inventor: Ernest J. Seijas, 5076 Bluebird Ter., Lecanto, Fla. 34461

[21] Appl. No.: 682,017

[22] Filed: Jul. 16, 1996

[51] Int. Cl.[6] ..... B63B 17/00

[52] U.S. Cl. ..... 114/361

[58] Field of Search ..... 114/343, 348, 114/360, 361, 362, 363, 364

[56] References Cited

U.S. PATENT DOCUMENTS

| | | | |
|---|---|---|---|
| 2,478,042 | 8/1949 | Elling | 114/348 |
| 3,734,047 | 5/1973 | Burton | 114/361 |
| 3,810,266 | 5/1974 | Iller | 114/361 |
| 4,554,884 | 11/1985 | Bouliane | 114/361 |

*Primary Examiner*—Stephen Avila

*Attorney, Agent, or Firm*—A. W. Fisher, III

[57] ABSTRACT

A cockpit canopy seperably coupled to a superstructure of a boat selectively convertible to a flotation device comprising a buoyant member including an inner surface having a ridge extending outwardly therefrom to cooperatively form an auxiliary cockpit with at least one attachment element formed on each side of the buoyant member and a corresponding coupling element movable between a first and second position mounted on opposite sides of the superstructure to engage the corresponding attachment element when in the first position to secure the buoyant member to the superstructure and to disengage the corresponding attachment element when moved from the first position to the second position to release the buoyant member from the superstructure for deployment as a flotation device in a body of water.

35 Claims, 4 Drawing Sheets

FLOTATION SAFETY DEVICE

BACKGROUND OF THE INVENTION

1. Field of the Invention

A cockpit canopy removably coupled to a boat superstructure convertible to a flotation device.

2. Description of the Prior Art

Fishermen and especially salt-water fishermen who fish from smaller craft are often faced with the perils of rough water caused by sudden weather changes. Oftentimes, the fishermen are forced to abandon their craft. Although life vests are required by law, there is a need for additional safety equipment.

U.S. Pat. No. 4,319,534 teaches a boat dingy which serves as a cockpit while underway and as a cabin top when moored.

U.S. Pat. No. 3,754,047 shows a detachable dingy for a sail boat that can also serve as a portion of the cabin or canopy of a sail boat.

U.S. Pat. No. 4,554,884 discloses a trailer to tow a water-craft including a convertible cover attached to the top deck by quick release latches.

U.S. Pat. No. 3,348,073 relates to a boat including a removable top attached to the hull by toggle fasteners.

Additional examples of the prior art are found in: U.S. Pat. No. 1,455,994; U.S. Pat. No. 3,001,212; U.S. Pat. No. 3,810,266; U.S. Pat. No. 4,020,513; U.S. Pat. No. 4,683,900 and WO 92/13755.

SUMMARY OF THE INVENTION

The present invention relates to a cockpit canopy seperably coupled to a superstructure of a boat selectively convertible to a flotation device comprising a buoyant member including an inner surface having a ridge extending outwardly therefrom. The inner surface and the ridge cooperatively form an auxiliary cockpit when used as the flotation device. At least one attachment element is formed on each side of the buoyant member; while, a corresponding coupling element is mounted on each side of the superstructure and movable between a first position and second position to engage the corresponding attachment element when in the first position to secure the buoyant member to the superstructure and to disengage the corresponding attachment element when moved from the first position to the second position to release the buoyant member from the superstructure. The attachment elements and corresponding coupling elements cooperatively form a canopy mounting means.

Each attachment element comprising a notch formed in the ridge having an attachment rail disposed therein to engage at least a portion of the corresponding coupling element when in the first position. Each coupling element comprises a substantially horizontal support member affixed to the superstructure and a retainer member movably mounted to the superstructure disposed to engage the corresponding attachment rail when in the first position.

During use of the buoyant member as the cockpit canopy, each retainer member is disposed in the first position to secure the corresponding attachment rail to the corresponding lower substantially horizontal support member.

To remove the cockpit canopy from the superstructure, each retainer member is moved to the second position to disengage the corresponding attachment rail to release the buoyant member from the superstructure. The buoyant member may then be moved away from the superstructure for deployment as a flotation device in the water.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken with accompanying drawings in which.

Similar reference characters refer to similar parts throughout the several views of the drawings.

DETAILED DESCRIPTION OF THE PREFERRED EMBODIMENT

Figure 1:
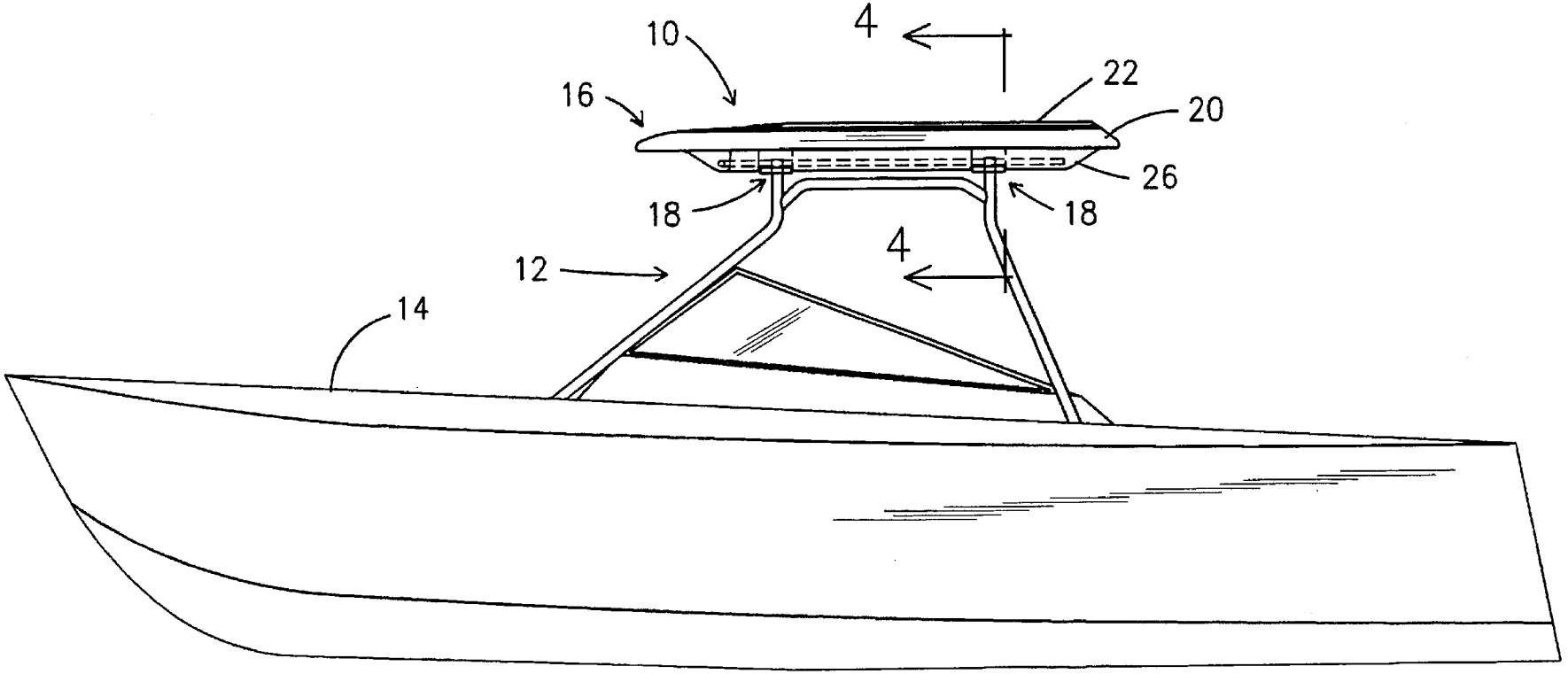
FIG. 1 is a side view of the cockpit canopy of the present invention mounted to the superstructure of a boat.

As best shown in FIG. 1, the present invention relates to a cockpit canopy generally indicated as 10 seperably coupled to a superstructure generally indicated as 12 of a boat 14 selectively convertible to a flotation device. As shown in FIGS. 1 and 4 through 6, the cockpit canopy 10 comprises a buoyant member generally indicated as 16 selectively secured to a portion of the superstructure 12 by a canopy mounting means including a plurality of mounting assemblies each generally indicated as 18.

Figure 2:
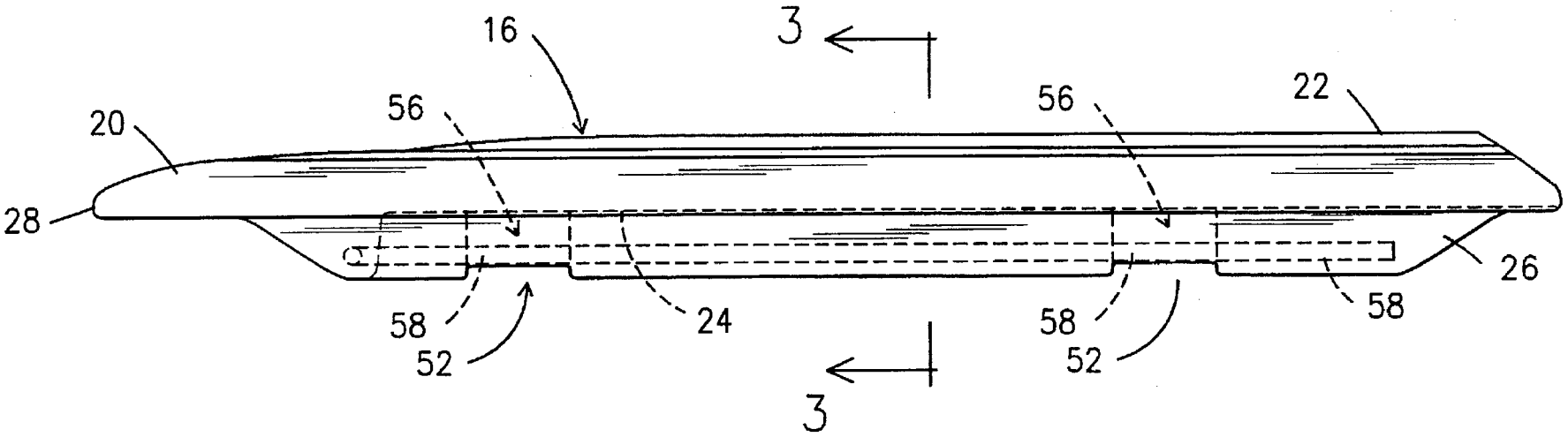
FIG. 2 is a side view of the buoyant member of the present Invention.
Figure 3:
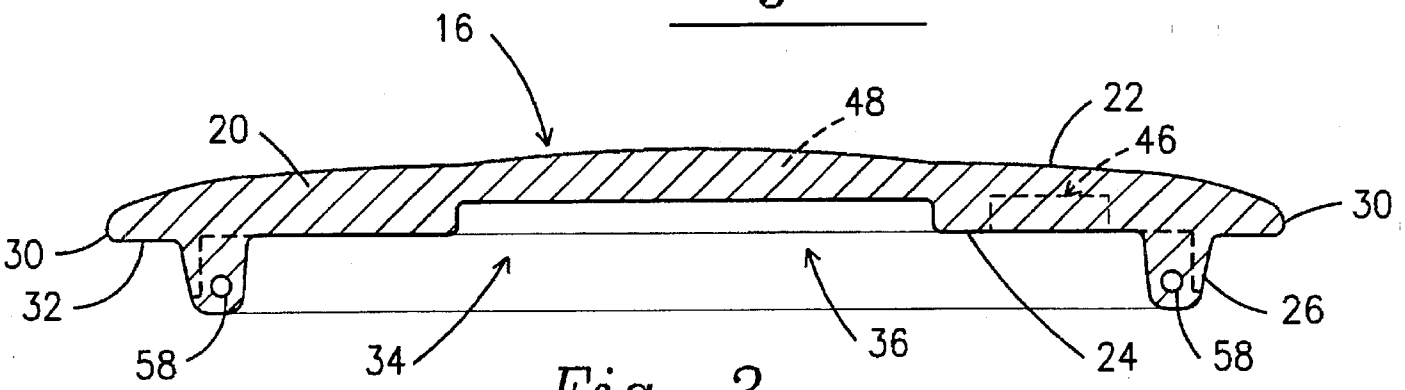
FIG. 3 is a cross-sectional end view of the present invention taken along line 3—3 of FIG. 2 of the buoyant member.
Figure 7:
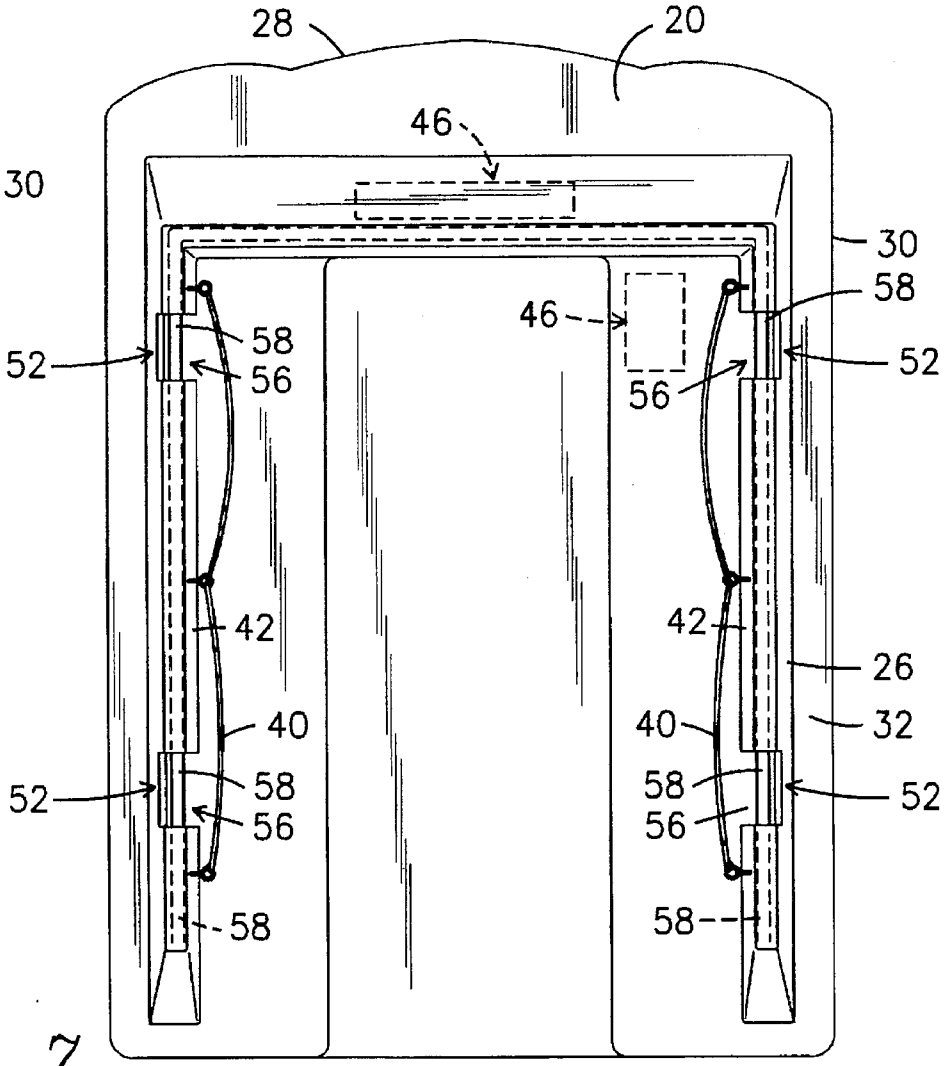
FIG. 7 is a plan view of the cockpit canopy of the present invention.

As best shown in FIGS. 2, 3 and 7, the buoyant member 16 comprises a body 20 having a substantially convex outer surface 22 and a substantially flat inner surface 24. A ridge 26 extending outwardly from the substantially flat inner Surface 16 is disposed in spaced relationship relative to the front edge 28 and each side edge 30 of the body 20 to create an overhang on peripheral ledge or surface 32. As best shown in FIGS. 3 and 7, the inner surface 24 and the ridge 26 cooperatively form an auxiliary cockpit 34. A longitudinally disposed recess 36 may be formed in the inner surface 24 to increase the effective depth of the auxiliary cockpit 34. As best shown in FIG. 7, the longitudinally disposed recess 36 may extend to the rear edge 38 of the body 20 to provide increased clearance between the cockpit canopy 10 and the floor of the boat cockpit when secured to the superstructure 12 and to facilitate boarding the cockpit canopy 10 when utilized as a flotation device.

Boarding of the buoyant member 16 may be further facilitated by lanyards 40 extending along the inner surface 42 of the ridge 26 and affixed thereto by a plurality of fastening means such as an attachment pin each indicated as 44. One or more storage compartments each indicated as 46 may be formed in the inner surface 24 of the body 20 to facilitate the storage of emergency equipment or other items.

Figure 5:
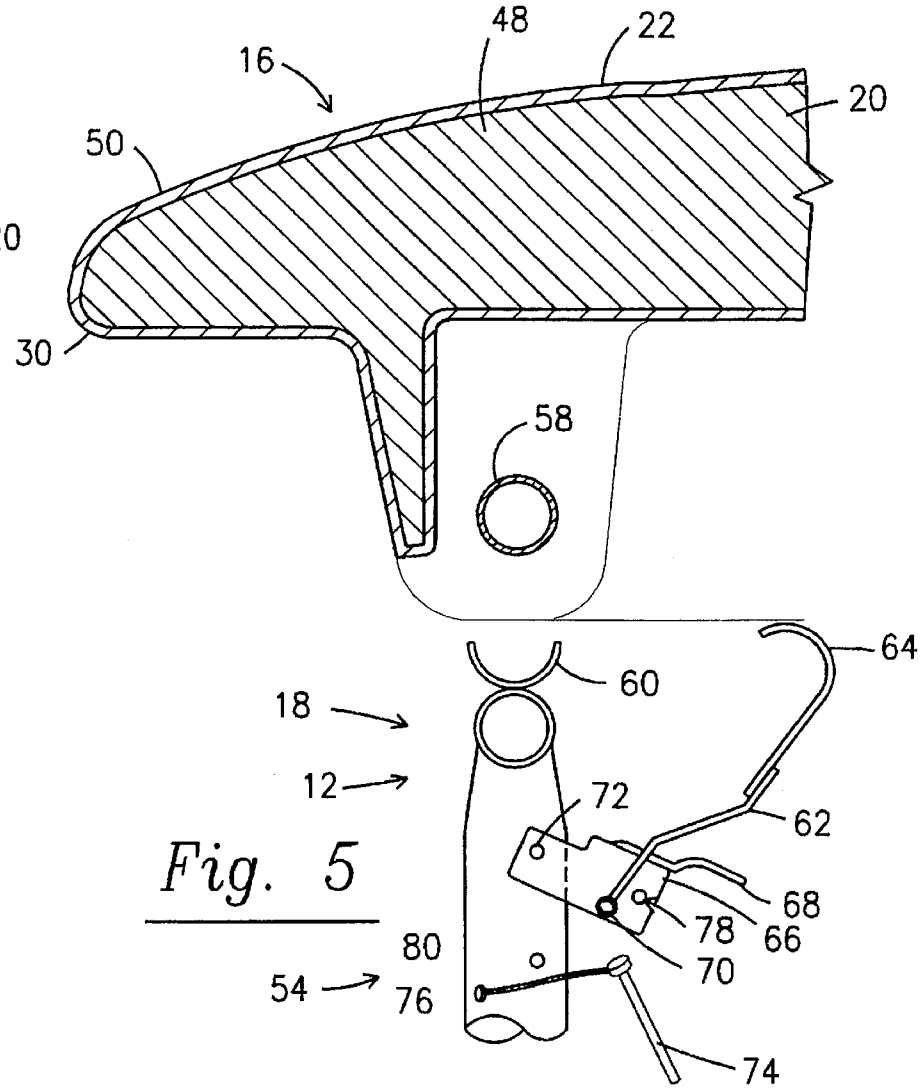
FIG. 5 is a partial detailed cross-sectional end view of the cockpit canopy of the present invention with the retainer member in the second position.
Figure 4:
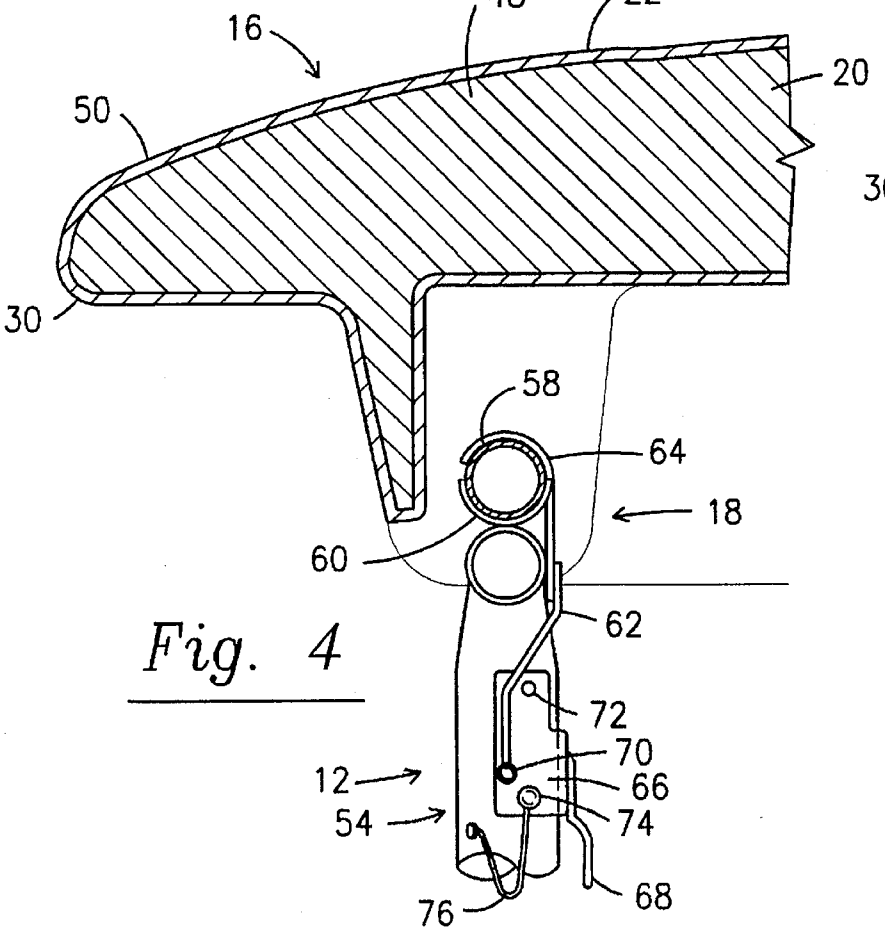
FIG. 4 is a partial detailed cross-sectional end view of the cockpit canopy of the present invention taken along line 4—4 of FIG. 1 with the retainer member in the first position.

As best shown in FIGS. 4 and 5, the body 20 may be constructed of an inner foam core 48 encapsulated in an outer rigid or semirigid coating or shell 50 of fiberglass or polymer.

Figure 6:
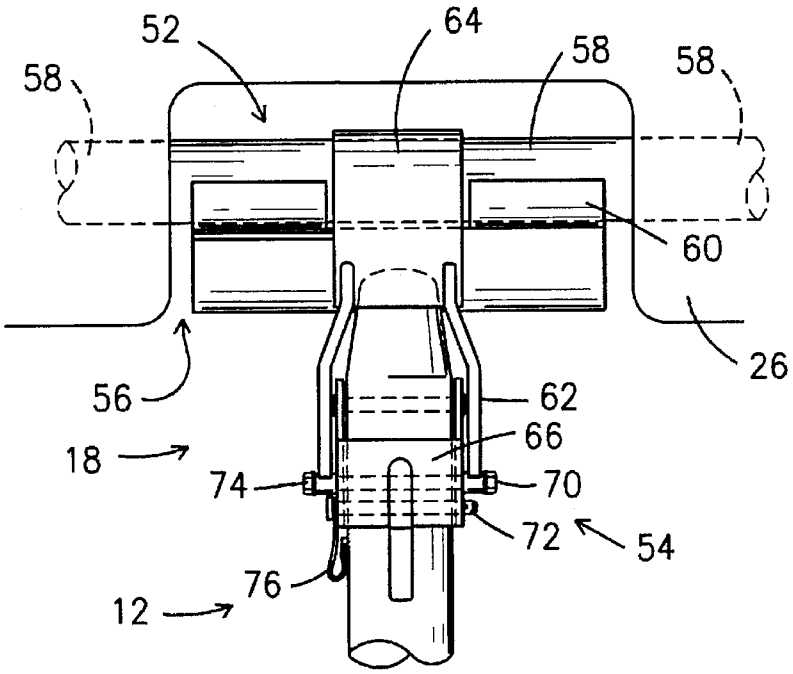
FIG. 6 is a detailed side view of the attachment element of the present invention with the retainer member in the first position.

As best shown in FIGS. 4 through 6, each mounting assembly 18 comprises an attachment element generally indicated as 52 and a corresponding coupling element generally indicated as 54.

As best shown in FIGS. 2, 6 and 7, each attachment element 52 comprises a notch 56 formed in the ridge 26 and a substantially cylindrical attachment member or mounting rail 58 affixed to the ridge 26 on opposite sides of the notch 56.

As best shown in FIGS. 4 through 6, each coupling element 54 comprises a substantially concave support member 60 affixed to the superstructure 12 and a retainer member 62 having a substantially concave retainer element 64 formed on an end portion thereof and pivotally coupled to an interconnecting member 66 including an actuator member 68 by a first pivot member 70 on the opposite end portion thereof. The interconnecting member 66 is pivotally mounted on the superstructure 12 by a second pivot member 72.

Although the substantially concave support members 60, the substantially concave retainer elements 64 and the substantially cylindrical attachment members or mounting rails 58 have arcuate configurations, these members and elements may be other obverse shapes or configurations such as rectilinear.

Each mounting assembly 18 may further include a locking mechanism to lock each coupling element 54 to the corresponding attachment element 56 to secure the cockpit canopy 10 to the superstructure 12 as shown in FIGS. 4 and 6. As best shown in FIGS. 4 through 6, each locking mechanism comprises a locking member or pin 74 tethered to the superstructure 12 by a flexible element 76, and a first aperture 78 and a second aperture 80 formed in the interconnecting member 66 of the corresponding coupling element 54 and the superstructure 12 respectively when the corresponding coupling element 54 is in the first position.

Selective use of the present invention as cockpit canopy 10 and as a flotation device is best understood with reference to each of the FIGS. 1 through 6. When the cockpit canopy 10 is coupled to the superstructure 12, the inner surface 24 of the buoyant member 16 faces the floor of the boat cockpit (FIG. 1). The substantially cylindrical attachment members or mounting rails 58 are clamped between the corresponding substantially concave support member 60 and the corresponding concave retainer element 64 when the corresponding coupling element 54 is in the first position (FIGS. 4 and 6). The locking member or pin 74 is inserted through the first and second apertures 78 and 80 when concentrically aligned to prevent movement of the corresponding coupling element 54. Each flexible element 76 retains the corresponding locking element or pin 74 when not inserted through the first and second apertures 78 and 80. As best shown in FIG. 6, the longitudinal dimension of the notches 56 is slightly greater than the longitudinal dimension of the corresponding concave retainer element 64 to limit longitudinal movement of the cockpit canopy 10 relative to the superstructure 12.

To remove the cockpit canopy 10 from the superstructure 12, each coupling element 54 is moved to the second position (FIG. 5) by removing the corresponding locking element or pin 74 and rotating the interconnecting element 66 upward toward the cockpit canopy 10 such that the retainer member 62 and the retainer element 64 move upward and away from the corresponding substantially cylindrical attachment member or mounting rail 58. Each retainer member 62 and the corresponding substantially concave retainer element 64 is then rotated outward and away from the corresponding substantially cylindrical attachment member or mounting rail 58 to allow vertical movement of the cockpit canopy 10 away from the superstructure 12 to be deployed into the water as a flotation device as shown in FIG. 7.

It will be seen that the objects set forth above, among those made apparent from the preceding description are efficiently attained and since certain changes may be made in the above description without departing from the scope of the invention, it is intended that all matter contained within the above description or shown in the accompanying drawings shall be interpreted as illustrative and not in a limiting sense.

It is also to be understood that that the following claims are intended to cover all of the general and specific and features of the invention herein described, and all statements of the scope of the invention which, as a matter of language, might be said to fall therebetween.

Now that the invention has been described,

What is claimed is:

1. A cockpit canopy separably coupled to a superstructure of a boat selectively convertible to a flotation device comprising a buoyant member including an outer surface and an inner surface having a ridge extending outwardly therefrom to cooperatively form an auxiliary cockpit with at least one mounting assembly formed on each side of said buoyant member to selectively secure said buoyant member to the superstructure and to release said buoyant member from the superstructure, each said mounting assembly comprises an attachment element and a corresponding coupling element, each said attachment element comprises a notch formed in said ridge and an attachment member affixed to said ridge.

2. The cockpit canopy of claim 1 wherein said buoyant member comprises a body having a substantially convex outer surface and a substantially flat inner surface with said ridge extending outwardly therefrom.

3. The cockpit canopy of claim 2 wherein said ridge extends outwardly from said substantially flat inner surface in spaced relationship relative to the front edge and each side edge of said body to create a peripherial ledge.

4. The cockpit canopy of claim 1 further including a longitudinally disposed recess formed in said inner surface.

5. The cockpit canopy of claim 4 wherein said longitudinally disposed recess extends to said rear edge of said body.

6. The cockpit canopy of claim 5 further including lanyards extending along the inner surface of said ridge.

7. The cockpit canopy of claim 1 further including at least one storage compartment formed in said inner surface.

8. The cockpit canopy of claim 1 wherein said buoyant member is constructed of an inner foam core encapsulated in an outer ridid shell.

9. The cockpit canopy of claim 1 wherein each said coupling element comprises a support member affixed to the superstructure and a retainer member having a retainer element formed on an end portion thereof and pivotally coupled to an interconnecting member by a first pivot member on the opposite end portion thereof said interconnecting member being attached to the superstructure, said retainer member being movable between a first and second portion such that each said attachment member is secured by said corresponding support member and said corresponding retainer element when said corresponding retainer member is in said first position and released from the superstructure when each said retainer member is moved to said second position to permit deployment of said cockpit canopy from the superstructure.

10. The cockpit canopy of claim 9 wherein said interconnecting member is pivotally mounted on the superstructure by a second pivot member.

11. The cockpit canopy of claim 9 wherein said interconnecting member further includes an arcuate member.

12. The cockpit canopy of claim 9 wherein each mounting assembly further includes a locking mechanism to lock each said coupling element to said corresponding attachment element to secure said cockpit canopy to the superstructure.

13. The cockpit canopy of claim 12 wherein each said locking mechanism comprises a locking member and a first aperture and second aperture formed in said interconnecting member of the corresponding coupling element and the superstructure respectively.

14. A cockpit canopy separably coupled to a superstructure of a boat selectively convertible to a flotation device comprising a buoyant member including a substantially convex outer surface and a substantially flat inner surface having a ridge extending outwardly therefrom to cooperatively form an auxiliary cockpit with at least one mounting assembly formed on each side of said buoyant member to selectively secure said buoyant member to the superstructure and to release said buoyant member from the superstructure, said buoyant member comprises a body including a front edge, a pair of side edges and a rear edge, said ridge extends outwardly from said substantially flat inner surface inwardly from said front edge and each said side edge of said body to create a peripheral ledge between said front edge and said side edges and said ridge on said substantially flat inner surface and wherein said auxiliary cockpit is open along said rear edge to provide access to said auxiliary cockpit.

15. The cockpit canopy of claim 14 further including a longitudinally disposed recess formed in said inner surface.

16. The cockpit canopy of claim 15 wherein said longitudinally disposed recess extends to said rear edge of said body.

17. The cockpit canopy of claim 16 further including lanyards extending along the inner surface of said ridge.

18. The cockpit canopy of claim 14 further including at least one storage compartment formed in said inner surface.

19. The cockpit canopy of claim 14 wherein said buoyant member is constructed of an inner foam core encapsulated in an outer rigid shell.

20. The cockpit canopy of claim 14 wherein said each mounting assembly comprises an attachment element and a corresponding coupling element.

21. The cockpit canopy of claim 20 wherein each attachment element comprises a notch formed in said ridge and an attachment member affixed to said ridge.

22. The cockpit canopy of claim 21 wherein each said coupling element comprises a support member affixed to the superstructure and a retainer member having a retainer element formed on an end portion thereof and pivotally coupled to an interconnecting member by a first pivot member on the opposite end portion thereof said interconnecting member being attached to the superstructure, said retainer member being movable between a first and second portion such that each said attachment member is secured by said corresponding support member and said corresponding retainer element when said corresponding retainer member is in said first position and released from the superstructure when each said retainer member is moved to said second position to permit deployment of said cockpit canopy from the superstructure.

23. The cockpit canopy of claim 22 wherein said interconnecting member is pivotally mounted on the superstructure by a second pivot member.

24. The cockpit canopy of claim 22 wherein said interconnecting member further includes an arcuate member.

25. The cockpit canopy of claim 22 wherein each mounting assembly further includes a locking mechanism to lock each said coupling element to said corresponding attachment element to secure said cockpit canopy to the superstructure.

26. The cockpit canopy of claim 25 wherein each said locking mechanism comprises a locking member and a first aperture and second aperture formed in said interconnecting member of the corresponding coupling element and the superstructure respectively.

27. A cockpit canopy separably coupled to a superstructure of a boat selectively convertible to a flotation device comprising a buoyant member having a front edge, a pair of side edges and a rear edge and including an outer surface and an inner surface having a ridge extending outwardly therefrom to cooperatively form an auxiliary cockpit with at least one mounting assembly formed on each side of said buoyant member to selectively secure said buoyant member to the superstructure and to release said buoyant member from the superstructure, said inner surface includes a longitudinally disposed recess formed therein extending to said rear edge of said buoyant member to permit access to said auxiliary cockpit.

28. The cockpit canopy of claim 27 wherein said ridge is disposed inwardly from said front edge and each said side edge to create a peripheral ledge therebetween on said inner surface.

29. The cockpit canopy of claim 27 wherein said each mounting assembly comprises an attachment element and a corresponding coupling element.

30. The cockpit canopy of claim 27 wherein each attachment element comprises a notch formed in said ridge and an attachment member affixed to said ridge.

31. The cockpit canopy of claim 30 wherein each said coupling element comprises a support member affixed to the superstructure and a retainer member having a retainer element formed on an end portion thereof and pivotally coupled to an interconnecting member by a first pivot member on the opposite end portion thereof said interconnecting member being attached to the superstructure, said retainer member being movable between a first and second portion such that each said attachment member is secured by said corresponding support member and said corresponding retainer element when said corresponding retainer member is in said first position and released from the superstructure when each said retainer member is moved to said second position to permit deployment of said cockpit canopy from the superstructure.

32. The cockpit canopy of claim 31 wherein said interconnecting member is pivotally mounted on the superstructure by a second pivot member.

33. The cockpit canopy of claim 31 wherein said interconnecting member further includes an arcuate member.

34. The cockpit canopy of claim 31 wherein each mounting assembly further includes a locking mechanism to lock each said coupling element to said corresponding attachment element to secure said cockpit canopy to the superstructure.

35. The cockpit canopy of claim 34 wherein each said locking mechanism comprises a locking member and a first aperture and second aperture formed in said interconnecting member of the corresponding coupling element and the superstructure respectively.

* * * * *